United States Patent [19]

Volle

[11] 4,094,468

[45] June 13, 1978

[54] HAND SHOWER

[75] Inventor: Günter Volle, Bad Liebenzell, Germany

[73] Assignee: Schläfer G.m.b.H. & Co., Bad Liebenzell, Germany

[21] Appl. No.: 746,808

[22] Filed: Dec. 2, 1976

[30] Foreign Application Priority Data

Dec. 24, 1975 Germany ..... 2558796

[51] Int. Cl.[2] ..... B05B 1/18; A47K 3/22

[52] U.S. Cl. ..... 239/394; 239/428.5; 239/553; 239/590

[58] Field of Search ..... 239/102, 391–394, 239/428.5, 487, 553, 590

[56] References Cited

U.S. PATENT DOCUMENTS

| | | | |
|---|---|---|---|
| 2,324,147 | 7/1943 | Gendron | 239/487 |
| 2,388,093 | 10/1945 | Smith | 239/394 |
| 3,516,611 | 6/1970 | Piggott | 239/394 X |
| 3,830,432 | 8/1974 | Grohe | 239/394 |

FOREIGN PATENT DOCUMENTS

| | | | |
|---|---|---|---|
| 2,408,316 | 9/1975 | Germany | 239/394 |

*Primary Examiner*—Evon C. Blunk
*Assistant Examiner*—Andres Kashnikow

[57] ABSTRACT

A multi-function shower head having an internal flow passage provided with an inlet end and an outlet end. A stationary cover plate is disposed at the outlet end of the passage, the cover plate being formed with an axially open and eccentric counterbore. A nozzle plate is rotatably mounted at the outlet end, outwardly of the cover plate, and in close proximity thereto. The nozzle plate is provided with a plurality of nozzle passages peripherally spaced apart and eccentrically disposed, such that each of the nozzle passages is adapted to selectively register with the eccentric counterbore. The shower head includes also a U-shaped baffle carried in the flow passage, and a coil spring extending in the counterbore passage, that serve to impart turbulence to water flowing through the counterbore and being discharged from the nozzle plate.

12 Claims, 6 Drawing Figures

Fig. 1
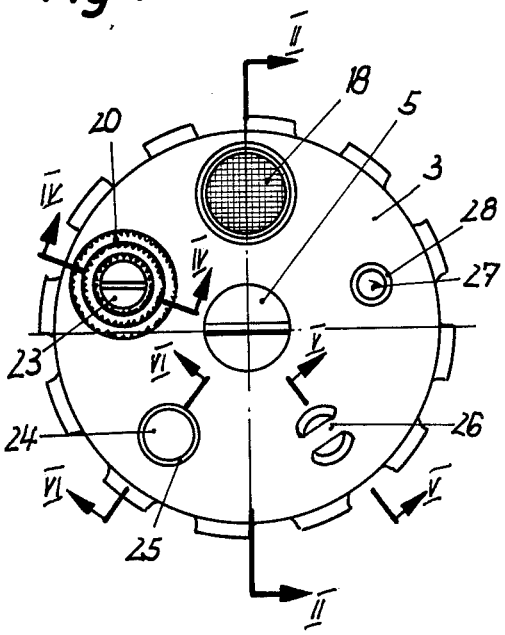
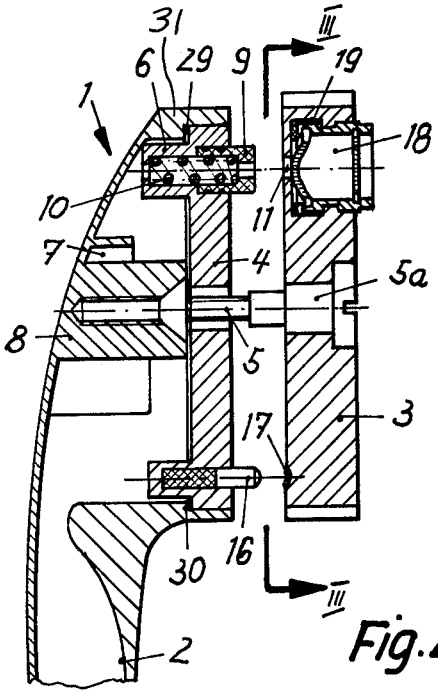
Fig. 2
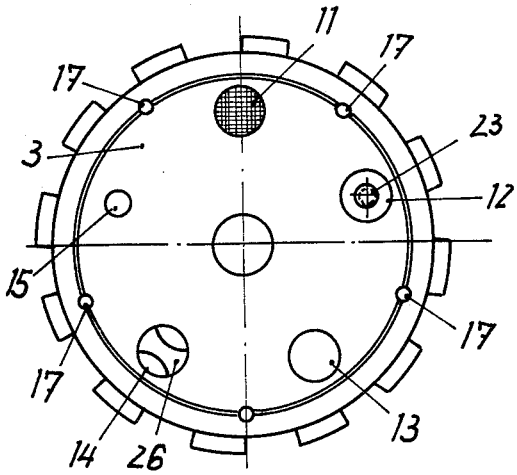
Fig. 3
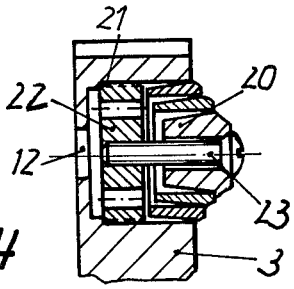
Fig. 4
Fig. 5
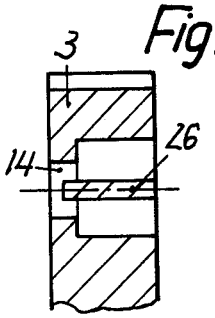
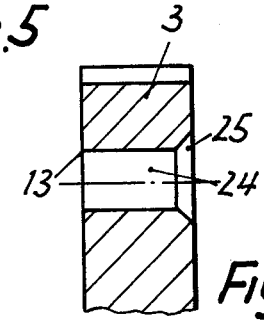
Fig. 6

HAND SHOWER

This invention relates to a hand shower comprising a multifunction shower head.

Known hand showers comprise a shower head which is mounted on the handle for rotation about the longitudinal axis of the latter so that different nozzles can be selected in dependence on the position of the shower head. Such showers comprising a rotatable shower head require expensive novel shapes as well as a high structural expenditure also for sealing. Finally, the interior of these shower heads cannot be cleaned by an unskilled person because it is not easily accessible. On the other hand, such cleaning is required because the cross-section of flow of the shower may be restricted by rust particles and the like which have been entrained by the water in the mains.

The Opened German Specification No. 24 08 316 discloses a water dispenser, which is provided with a multi-function shower head, which is closed at its end by a nozzle plate that extends transversely to the longitudinal axis of the head and carries a plurality of nozzle inserts, which are arranged in a circle. Said nozzle plate is rotatably mounted adjacent to a cover plate that has an eccentric port so that each nozzle insert can be selected by a rotation of the shower head to the proper position. That water dispenser is suitable for dish-washing purposes rather than for a bath shower.

It is an object of the invention to provide for existing bath showers a multi-function shower head which can easily be cleaned and assembled so that the installation is also simplified, and which discharges a pulsating jet of water, which exerts a massage action, although the shower head has no mechanically movable parts.

In a hand shower having a multi-function shower head which comprises at its outer end a nozzle plate, which extends transversely to the longitudinal axis of the shower head and carries a plurality of nozzle inserts arranged in a circle, is rotatably mounted adjacent to a cover having an eccentric counterbore so that each nozzle insert can be selected by a rotation of the shower head to the proper position, this object is accomplished by a combination of the following features:

(a) A flow-dividing U-shaped baffle which is downwardly open, is mounted in the shower head and is spaced around a central socket for receiving a screw;

(b) The eccentric counterbore in the cover plate is formed as an axially open counterbore extending into a coaxially inwardly protruding boss which constitutes an integral part of the cover plate;

(c) The eccentric counterbore contains a coil spring which serves to impart turbulance to water flowing through the counterbore, and a shaped sealing element interposed between the coil spring and said nozzle plate and urged by the coil spring against the nozzle plate around an inlet opening which communicates with the selected nozzle insert.

Experiments have shown that the combination of the flow-dividing baffle and the succeeding coil spring result in a pulsating water jet without need for mechanically movable parts.

Further details of the hand shower comprising a multi-function shower head in accordance with the invention will now be explained with reference to an embodiment shown by way of example on the drawing, in which FIGS. 1 and 2 are, respectively, a top plan view and a transverse section view showing a shower head, which is seen in FIG. 2 in a condition in which the nozzle plate is not yet fully mounted;

FIG. 3 is an elevation showing the nozzle plate viewed from the rear; and

FIGS. 4 to 6 are fragmentary transverse sectional views showing the various nozzle inserts.

As is apparent from the drawing, the multifunction shower head comprises a handle 2 and shower head 1 carrying at its outer end a transverse nozzle plate 3, which is disposed over a cover plate 4 and rotatably mounted by means of a screw 5. The shower head 1 includes an internal flow passage having an inlet end and an outlet end. The cover plate 4 comprises an inwardly protruding, eccentric counterbore 6. The water is received from the handle 2 and is divided by a U-shaped baffle 7, which is downwardly open and spaced around the centrally disposed, tapped socket 8, which is in threaded engagement with the screw 5. The cover plate 4 is formed with an axially outwardly open counterbore 6, whose bore extends into a coaxially inwardly protruding boss which forms an integral part of the cover plate 4. The eccentric counterbore 6 contains a coil spring 10 and a shaped sealing element 9, which is urged by the coil spring 10 against the nozzle plate 3 and in dependence on the angular position of the latter is adapted to register with any of the inlet openings 11 to 15 formed in the nozzle plate. The sealing element 9 is formed with a radially inwardly extending shoulder which is inwardly facing, and engaging the coil spring 10. The coil spring 10 serves also to impart turbulence to the water jet so that the combination of the flow-dividing baffle 7 and the succeeding coil spring 10 results in a pulsating flow of water. The cover plate 4 carries also a resilient detent pin 16, which is diametrically opposite to the counterbore 6 and cooperates with peripherally spaced apart indentations 17 formed in the nozzle plate 3 in order to hold the latter in its selected position. The indentations 17, are open towards the cover plate 4 and have the same eccentricity as the detent pin 16, so as to receive the detent pin, when one of the respective nozzle inserts registers with the eccentric counterbore.

The nozzle plate contains a plurality of various nozzle inserts, which communicate with respective ones of the inlet openings 11 to 15. Each of these inlet openings faces the cover plate. The nozzle plate is formed with a tapped opening which is open on the side opposite to the cover plate. In the embodiment shown on the drawing, the inlet opening 11 communicates with a known water-air mixing nozzle 18, which is screwed into a tapped opening 19. The inlet opening 12 communicates through a distributing disc 22, with an annular-orifice nozzle 20. The disc 22 is screw-threaded in a tapped opening 21. The nozzle 20 is fixed to the disc 22 by a screw 23. The inlet opening 13 communicates with a cylindrical or conical bore 24, which is chamfered at its outlet end 25. The inlet opening 14 communicates with a passage that contains a flow-dividing web 26, which extends across the nozzle passage axially outwardly of the inlet opening, for producing a double jet. Like the inlet opening 13, the inlet opening 15 communicates with a cylindrical or conical bore 27, which has a chamfered outlet end 28 but is smaller in diameter than the bore 24 so that a harder water jet is produced.

As has been described hereinbefore, the nozzle plate 3 overlying the cover plate 4 is rotatably mounted in the shower head 1 to extend transversely to the axis of the shower head. The nozzle plate 3 is rotatably mounted on a cylindrical portion 5*a* of the screw 5. The cover plate 4 is held in position against an annular shoulder 30 of the shower head 1. A gasket 29 is interposed between the cover plate 4 and the shoulder 30. The screw 5 is screwed into a socket 8, which is disposed in the flow passage, and having a tapped screw receiving opening. A known flow-dividing U-shaped baffle 7, which is downwardly open, is spaced around the socket 8. The screw 5 extends coaxially in the outlet end, and the screw receiving opening is detachably affixed in the head body. The screw 5 has a screw-threaded portion which is threadedly affixed in the tapped screw opening, and a cylindrical portion extending outwardly of the cover plate and into the nozzle plate 3, which is mounted on the cylindrical portion. The cover plate 4 is formed in the area of the counterbore 6, with a radially inwardly extending shoulder 31 which is axially and outwardly facing and surrounding the coil spring 10. The inner end face of the sealing element 9 is axially aligned with the shoulder 31.

What is claimed is:

1. A hand shower, which comprises a head body defining an internal flow passage, having an inlet end and an outlet end, a socket carried by said head body in said flow passage and having a screw-receiving opening which is coaxial with said outlet end, a screw which extends coaxially in said outlet end, and said screw-receiving opening is detachably fixed in said head body, a U-shaped baffle carried by said head body in said flow passage, and spaced around said socket and open toward said inlet end, and adapted to divide a flow entering said passage through said inlet end, a stationary cover plate coaxially mounted on said screw disposed in said outlet end, and formed with an axially open and eccentric counterbore, which is disposed on that side of said socket that is opposite to said inlet end, a nozzle plate which is rotatably mounted on said screw in said outlet end, axially outwardly of said cover plate and in close proximity thereto, an annular sealing element which is in sealing contact with said counterbore and protrudes from said cover plate to engage said nozzle plate, a coil spring disposed in said counterbore, axially inwardly of said sealing element, and engaging the latter to urge it against said nozzle plate and adapted to impart turbulance to liquid flowing through said counterbore, and a plurality of different nozzle passages, which extend through said nozzle plate and are eccentrically disposed therein, peripherally spaced apart and have the same eccentricity as said counterbore, so that each of said nozzle passages is adapted to selectively register with said counterbore.

2. A hand shower as set forth in claim 1, in which said sealing element is formed with a radially inwardly extending shoulder, axially inwardly facing and engaging said coil spring.

3. A hand shower as set forth in claim 2, in which said cover plate is formed in said counterbore with a radially inwardly extending second shoulder, axially outwardly facing and surrounding said coil spring, and said sealing element has an axially inner end face axially aligned with said second shoulder.

4. A hand shower is set forth in claim 1, in which said cover plate carries an eccentric resilient detent pin and said nozzle plate has a plurality of peripherally spaced apart indentations which have the same eccentricity as said detent pin and open toward said cover plate and are arranged to receive said detent pin when respective ones of said nozzle inserts register with said counterbore.

5. A hand shower as set forth in claim 4, in which said detent pin is diametrically opposite to said counterbore.

6. A hand shower as set forth in claim 1, in which said nozzle plate is formed with a tapped opening which is open on the side opposite to said cover plate, one of said nozzle passages comprises an inlet orifice which faces said cover plate and is coaxial with said tapped opening, and a water-air mixing nozzle is screw-threaded in said tapped opening and defines part of said one nozzle passage.

7. A hand shower as set forth in claim 1, in which said nozzle plate is formed with a tapped opening which is open on the side opposite to said cover plate, one of said nozzle passages comprises an inlet orifice which faces said cover plate and is coaxial with said tapped opening, a distributing disc is screw-threaded in said tapped opening and defines a plurality of ports, a nozzle having an annular orifice is detachably connected to said distributing disc and disposed on the side thereof which is opposite to said cover plate, and one of said nozzle passages comprises an inlet orifice which faces said cover plate and is coaxial with said tapped opening, said one nozzle passage further comprising said ports and said annular orifice.

8. A hand shower as set forth in claim 1, in which one of said nozzle passages comprises an inlet orifice which faces said cover plate and said nozzle plate carries a flow-dividing web which extends across said one nozzle passage axially outwardly of said inlet orifice.

9. A hand shower as set forth in claim 1, in which one of said nozzle passages comprises an inlet orifice facing said cover plate and said one nozzle passage further comprises a cylindrical bore.

10. A hand shower as set forth in claim 1, in which said screw-receiving opening is a tapped opening, said screw has a screw-threaded portion which is screw-threadedly fixed in said tapped opening, and a cylindrical portion extending into said nozzle plate, and said nozzle plate is rotatably mounted on said cylindrical portion.

11. A hand shower as set forth in claim 1, in which said screw-receiving opening is a tapped opening, said screw has a screw-threaded portion which is screw-threadedly fixed in said tapped opening, and a cylindrical portion which extends into said nozzle plate and is larger in diameter than said screw-threaded portion and defines said axially inwardly facing shoulder, and said nozzle plate is rotatably mounted on said cylindrical portion.

12. A hand shower as set forth in claim 1, which comprises at least one nozzle insert detachably mounted in said nozzle plate and defining one of said nozzle passages.

* * * * *